US011226077B2

(12) United States Patent
Chen et al.

(10) Patent No.: US 11,226,077 B2
(45) Date of Patent: Jan. 18, 2022

(54) PROJECTION DEVICE AND HEADLIGHT FOR VEHICLE

(71) Applicant: Young Optics Inc., Hsinchu (TW)

(72) Inventors: S-Wei Chen, Hsinchu (TW); Yung-Ming Chuang, Hsinchu (TW)

(73) Assignee: Young Optics Inc., Hsinchu (TW)

( * ) Notice: Subject to any disclaimer, the term of this patent is extended or adjusted under 35 U.S.C. 154(b) by 0 days.

(21) Appl. No.: 17/142,293

(22) Filed: Jan. 6, 2021

(65) Prior Publication Data

US 2021/0207784 A1 Jul. 8, 2021

(30) Foreign Application Priority Data

Jan. 6, 2020 (TW) ..... 109100318

(51) Int. Cl.

| | |
|---|---|
| ***F21S 41/25*** | (2018.01) |
| ***F21S 41/40*** | (2018.01) |
| ***F21S 41/20*** | (2018.01) |
| *F21S 41/153* | (2018.01) |

(52) U.S. Cl.

CPC ..... *F21S 41/25* (2018.01); *F21S 41/285* (2018.01); *F21S 41/40* (2018.01); *F21S 41/153* (2018.01)

(58) Field of Classification Search

None

See application file for complete search history.

(56) References Cited

U.S. PATENT DOCUMENTS

| | | | | |
|---|---|---|---|---|
| 2014/0118702 | A1* | 5/2014 | Taniguchi | G03B 21/14 353/38 |
| 2015/0377442 | A1* | 12/2015 | Bhakta | F21S 41/25 362/510 |
| 2016/0290583 | A1* | 10/2016 | Suwa | F21S 41/43 |
| 2016/0347237 | A1* | 12/2016 | Bhakta | F21S 41/285 |
| 2017/0108704 | A1* | 4/2017 | Ishida | G02B 13/0095 |
| 2017/0175969 | A1* | 6/2017 | Gut | F21S 41/147 |
| 2017/0241606 | A1* | 8/2017 | Courcier | F21S 41/153 |
| 2018/0045393 | A1* | 2/2018 | Yagi | F21S 41/321 |
| 2018/0099605 | A1* | 4/2018 | Ahn | B60Q 1/076 |
| 2019/0063717 | A1* | 2/2019 | Potter | F21S 41/285 |
| 2019/0145599 | A1* | 5/2019 | Kogure | F21S 41/645 362/514 |
| 2020/0032976 | A1* | 1/2020 | Shimada | F21S 41/176 |

* cited by examiner

*Primary Examiner* — Elmito Breval

(57) ABSTRACT

A projection device and a headlight for vehicle are provided. The projection device includes a light source, a light valve and a projection lens. The light source is used to emit a light beam. The light valve is located at the downstream of an optical path of the light source. The projection lens is located at the downstream of an optical path of the light valve and has an optical axis. The light valve is located on the optical axis of the projection lens and is tilted with respect to the projection lens to form an acute angle with the optical axis. The projection lens is used for projecting the light beam on a first projection surface and a second projection surface.

20 Claims, 7 Drawing Sheets

PROJECTION DEVICE AND HEADLIGHT FOR VEHICLE

This application claims the benefit of Taiwan application Serial No. 109100318, filed Jan. 6, 2020, the subject matter of which is incorporated herein by reference.

BACKGROUND OF THE INVENTION

Field of the Invention

The invention relates in general to a projection device and a headlight, and more particularly to a projection device and a headlight for vehicle.

Description of the Related Art

Currently, the two projection surfaces projected by the projection device have different levels of resolution. Normally, the resolution of one of the two projection surfaces is poor, making the entire projection quality deteriorate. Therefore, it has become a prominent task for the industries to provide a new projection device capable of resolving the above problem.

SUMMARY OF THE INVENTION

The invention is directed to a projection device and a headlight for vehicle capable of resolving the above problem.

According to one embodiment the present invention, a projection device for vehicle is provided. The projection device includes a light source, a light valve and a projection lens. The light valve is located at a downstream of an optical path of the light source. The projection lens is located at a downstream of an optical path of the light valve and has an optical axis. The light valve is located on the optical axis of the projection lens and is tilted with respect to the projection lens to form an acute angle with the optical axis. The projection lens is used for projecting a light beam emitted from the light source on a first projection surface and a second projection surface substantially perpendicular to the first projection surface. Since the light valve is tilted with respect to the optical axis, the resolution of the projection surface is increased.

According to another embodiment the present invention, a projection device for vehicle is provided. The projection device includes a light valve, a projection lens and a lampshade. The light valve includes several self-luminous light-emitting elements arranged in form of a matrix. The projection lens is located at a downstream of an optical path of the light valve and has an optical axis. The lampshade is located at a downstream of an optical path of the projection lens. The light valve is located on the optical axis of the projection lens and is tilted with respect to the projection lens to form an acute angle with the optical axis. The projection lens is used for projecting a light beam with a pattern emitted from the light valve passes through the lampshade on a first projection surface and a second projection surface substantially perpendicular to the first projection surface. Since the light valve is tilted with respect to the optical axis, the resolution of the projection surface is increased.

According to another alternate embodiment the present invention, a headlight is provided. The headlight includes a self-luminous light valve, a lens group and a lampshade. The lens group is arranged at a downstream of an optical path of the light valve. The lampshade is arranged at a downstream of an optical path of the lens group. The optical axis of the self-luminous light valve substantially is not parallel to an optical axis of the lens group, and the lens group is used for projecting a light beam with a pattern emitted from the self-luminous light valve passes through the vehicle lampshade on a first projection surface and a second projection surface substantially perpendicular to the first projection surface.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
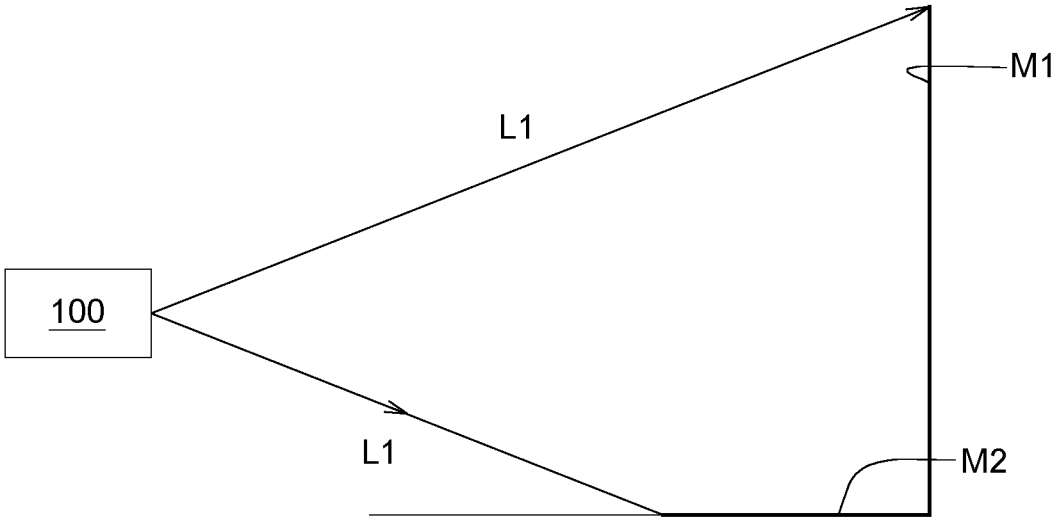
FIG. 1 is a schematic diagram of a projection device 100 projecting an image on a first projection surface M1 and a second projection surface M2 according to an embodiment of the present invention.
Figure 2:
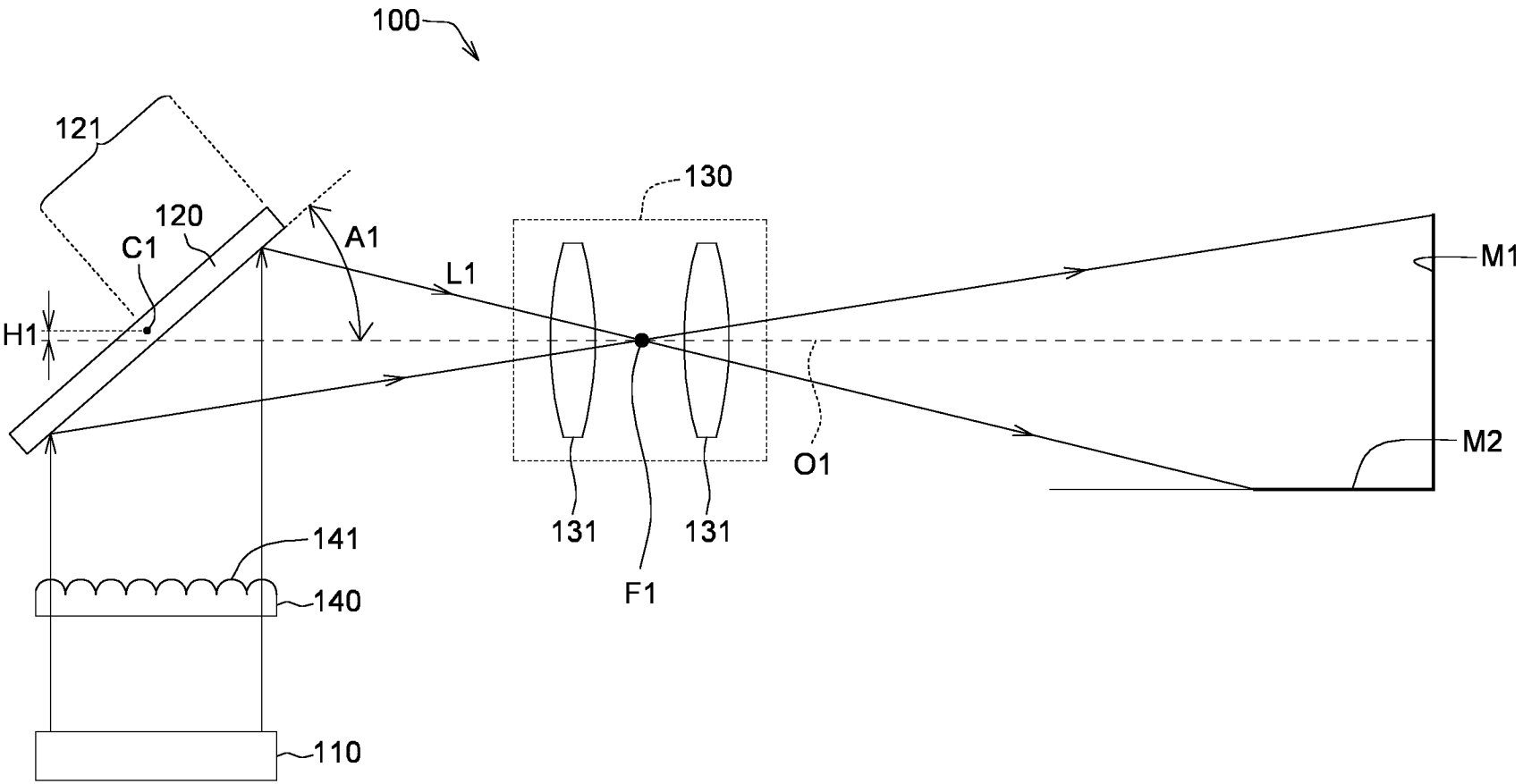
FIG. 2 is a schematic diagram of the projection device 100 of FIG. 1.

Refer to FIGS. 1 and 2. FIG. 1 is a schematic diagram of a projection device 100 projecting an image on a first projection surface M1 and a second projection surface M2 according to an embodiment of the present invention. FIG. 2 is a schematic diagram of the projection device 100 of FIG. 1.

As indicated in FIG. 2, the projection device 100 includes a light source 110, a light valve 120, a projection lens (or the lens group) 130 and a lens array 140. The light source 110, such as a light-emitting diode or other self-luminous light-emitting element, can emit a light beam L1. The light valve 120 is located at downstream of an optical path of the light source 110. Any of a digital micro-lens device (DMD), a liquid crystal display (LCD), a laser scanning and a silicon-based LCD panel (LCOS) can be used as the light valve of the present invention. The projection lens 130 is located at a downstream of an optical path of the light valve 120 and has an optical axis O1. The light valve 120 is located on the optical axis O1 of the projection lens 130. The optical axis of the light valve 120 substantially is not parallel to the optical axis O1 of the projection lens 130. For example, the light valve 120 is tilted with respect to the projection lens 130 to form an acute angle A1 with the optical axis O1. In an embodiment, the light valve 120 is arranged on the optical axis O1 with a first portion 121 of the light valve 120 being tilted towards the projection lens 130 or a second portion of the light valve 120 being tilted towards the projection lens 130. The first portion 121 refers to the portion above a center C1 of the light valve 120 and the second portion refers to the portion of the light valve 120 below the center C1. The projection lens 130 is used for projecting the light beam emitted from the light source 110 on a first projection surface M1 and a second projection surface M2 roughly (substantially or basically) perpendicular to the first projection surface M1. Since the light valve 120 is arranged on the optical axis O1 with the first portion 121 being tilted towards the projection lens 130, the resolution of the projection surface, such as the second projection surface M2, can be increased.

The first projection surface M1 and the second projection surface M2 are not co-planar, and the angle formed between the first projection surface M1 and the second projection surface M2 is not 0° or 180°. As indicated in FIG. 2, the first projection surface M1 and the second projection surface M2 are substantially perpendicular to each other. In an embodiment, the second projection surface M2 is such as the ground (or the horizon), and the first projection surface M1 is substantially perpendicular to the ground. In another embodiment, the angle between the first projection surface M1 and the second projection surface M2 may be any angle other than 90°.

In an embodiment, the acute angle A1 between the light valve 120 and the optical axis O1 is in a range of about 84° to 88°, such that the resolution of the second projection surface M2 can be increased, and the projection device 100 can provide a satisfactory projection quality.

When the light valve 120 is tilted, a focal point F1 of the light beam L1 reflected from the light valve 120 will be upwardly or downwardly deviated from the optical axis O1, causing the resolution of the projection surface to deteriorate accordingly. As indicated in FIG. 2, the center C1 of the light valve 120 is located above the optical axis O1, such that the focal point F1 of the light beam L1 reflected from the light valve 120 can return to the optical axis O1 and the resolution of the second projection surface M2 can be effectively increased. In an embodiment, a distance H1 between the center C1 of the light valve 120 and the optical axis O1 is in a range of 0.01 to 3 mm. However, the distance H1 between the center C1 of the light valve 120 and the optical axis O1 is not subjected to specific restrictions in the present invention, and any distance allowing the focal point F1 of the light beam L1 reflected from the light valve 120 to fall on the optical axis O1 would do. In another embodiment, the resolution of the second projection surface M2 is increased, and the center C1 of the light valve 120 is substantially located on the optical axis O1.

As indicated in FIG. 2, the projection lens 130 includes at least one lens 131 with a diopter. The number of the lens 131 can be one or more than one. The lens 131 can be arranged at the downstream of the optical path of the light valve 120. The lens 131 can be realized by a single lens or a cemented lens and can be used to correct aberrations.

As indicated in FIG. 2, the lens array 140 can be located at the upstream of an optical path of the light valve 120, such as located on the optical path between the light source 110 and the light valve 120. The lens array 140 includes several micro lens structures 141. The micro lens structures 141 can make the light beam L1 uniformed, such that most or whole of the uniformed light beam L1 can enter the light valve 120. In another embodiment, the lens array 140 can be omitted. In the present example, the light beam L1 emitted from the light source 110 directly enters the light valve 120 without passing through any physical optical elements, but the present invention is not limited thereto.

Figure 3:
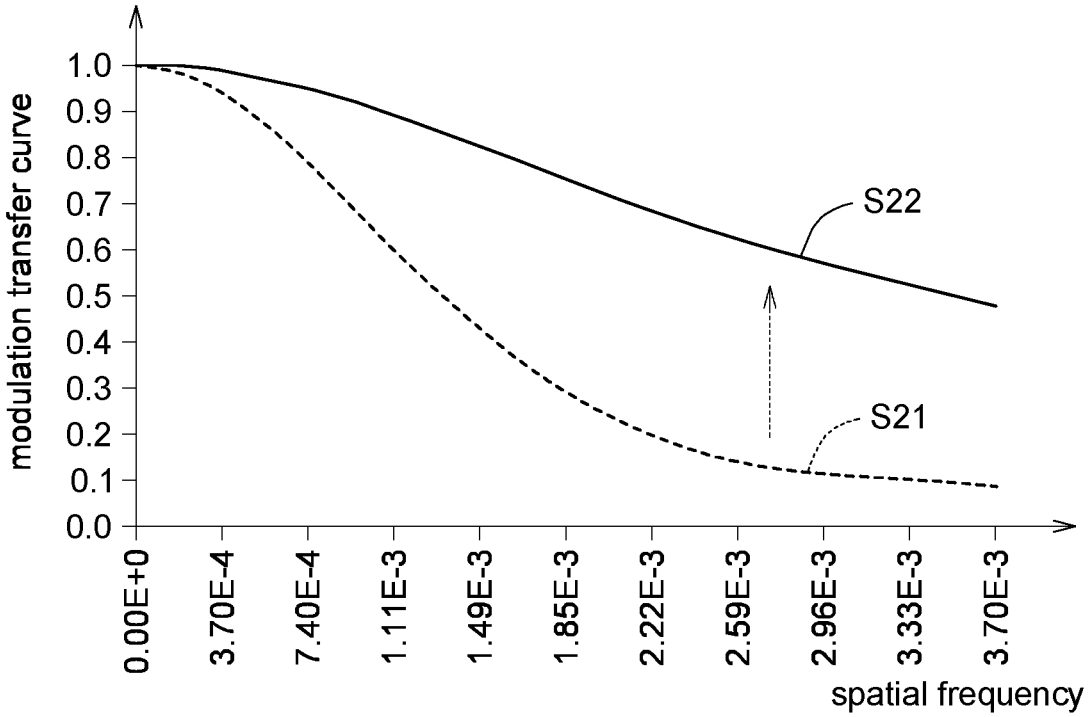
FIG. 3 is a curve chart of a modulation transfer curve S21 of the second projection surface M2 obtained when the light valve 120 is in vertical placement and a modulation transfer curve S22 of the second projection surface M2 obtained when the acute angle A1 of FIG. 2 is 84°.

Referring to FIG. 3, a curve chart of a modulation transfer curve S21 of a second projection surface M2 obtained when the light valve 120 is perpendicular to the optical axis O1 and a modulation transfer curve S22 of a second projection surface M2 obtained when the acute angle A1 of FIG. 2 is 84° is shown. In FIG. 3, the horizontal axis represents spatial frequency, and the vertical axis represents modulation transfer curve. The higher the modulation transfer curve, the better the resolution; the lower the modulation transfer curve, the poorer the resolution.

Since the modulation transfer curve S21 of the second projection surface M2 obtained when the light valve 120 is not tilted (the angle A1 is 90°) is lower than the modulation transfer curve S22 of the second projection surface M2 obtained when the light valve 120 is tilted (the acute angle A1 is 84°), the resolution of the second projection surface M2 will be increased when the light valve 120 is tilted.

Figure 4:
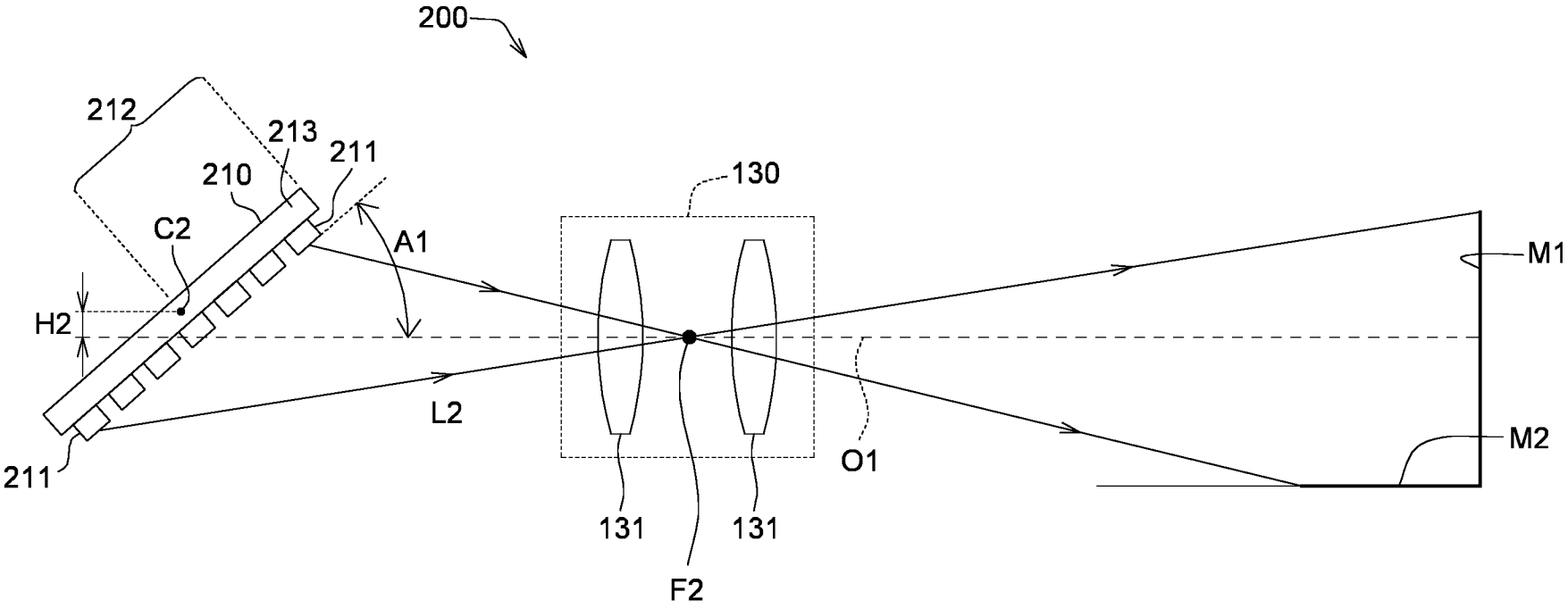
FIG. 4 is a schematic diagram of a projection device 200 according to another embodiment of the present invention.

Referring to FIG. 4 a schematic diagram of a projection device 200 according to another embodiment of the present invention is shown. The projection device 200 includes a light valve 210 and a projection lens 130. The projection device 200 is different from the projection device 100 in that the light valve 210 of the projection device 200 can emit a light beam L2 with a pattern, therefore the projection device 200 can selectively omit the light source.

The light valve 210, such as a self-luminous light valve, includes several self-luminous light-emitting elements 211 arranged in form of a matrix. The projection lens 130 is located at the downstream of an optical path of the light valve 210 and has an optical axis O1. The light valve 210 is located on the optical axis O1 of the projection lens 130, and is tilted with respect to the projection lens 130 to form the acute angle A1 with the optical axis O1. In the present embodiment, the first portion 212 of the light valve 210 is tilted towards the projection lens 130. The projection lens is used for projecting the light beam L2 emitted from the light valve 210 on a first projection surface M1 and a second projection surface M2. Since the light valve 210 is arranged on the optical axis O1 with the first portion 212 being tilted towards the projection lens 130, the resolution of the second projection surface M2 can be increased.

In an embodiment, the acute angle A1 between the light valve 210 and the optical axis O1 is in a range of about 84° to 88°, such that the resolution of the second projection surface M2 can be increased.

When the light valve 210 is tilted, a focal point F2 of the light beam L2 reflected from the light valve 210 will be upwardly or downwardly deviated from the optical axis O1, causing the resolution of the projection surface to deteriorate accordingly. As indicated in FIG. 4, the center C2 of the light valve 210 is located above the optical axis O1, such that the focal point F2 of the light beam L2 reflected from the tilted light valve 210 can return to the optical axis O1 and the resolution of the second projection surface M2 can be increased. In an embodiment, a distance H2 between the center C2 of the light valve 210 and the optical axis O1 is in a range of 0.01 to 3 mm. However, the distance H2 between the center C2 of the light valve 210 and the optical axis O1 is not subjected to specific restriction in the present invention, and any distance allowing the focal point F2 of the light beam L2 reflected from the light valve 210 to fall on the optical axis O1 would do. In another embodiment, the resolution of the second projection surface M2 is increased, and the center C2 of the light valve 210 is substantially located on the optical axis O1.

As indicated in FIG. 4, in the present embodiment, the light valve 210 includes several light-emitting elements 211 and a substrate 213, wherein the light-emitting elements 211 are arranged on the substrate 213, such as a circuit board. The light-emitting elements 211 can be realized by self-luminous light-emitting elements. In the present example, the light valve 210 does not require any backlight module. In an embodiment, the light-emitting elements 211, such as micro light-emitting diodes (micro LEDs), can be in a range of about 1 to 10 mm using the micrographics technology, and can be arranged on the substrate 213 using a suitable technology, such as the mass transfer technology. Then, the micro LEDs are packaged as single micro LED chip having a size less than 100 mm. Like the organic light-emitting diodes (OLED), the micro LED chip can implement individual positioning and individual illumination of each pixel (self-luminous) and is more power saving and has faster response rate than the OLED. In another embodiment, the light-emitting elements 211 can be realized by mini light-emitting diodes (mini LEDs) having a size in a range of about 100 to 200 mm. According to the classification of a LED electronic company, the size of an ordinary LED grain is in a range of about 200 to 300 mm, and the size of a mini LED is in a range of about 50 to 60 mm, and the size of a micro LED is about 15 mm. Therefore, size can be used as an auxiliary not the only criterion in classification. Other factors such as self-illumination and the LED production technology also need to be considered. In an embodiment, several light-emitting elements 211 can be controlled to illuminate independently. Since some light-emitting elements 211 illuminate but some others do not, the light beam L1 will represent a pattern. Moreover, the pattern of the light beam L1 can be changed by controlling the light-emitting elements 211. In other embodiments, the light-emitting elements 211 can emit lights of different colors (different color temperatures). For example, each of the light-emitting elements 211 can emit a different color light, such as read light, blue light, green light or white light. Or, all of the light-emitting elements 211 can emit one single color light of different grayscales, such as a white light or a color light of any color temperature.

Besides, the light-emitting elements 211 can be arranged as an n×m matrix, wherein n and m both are a positive integer equal to or greater than 1, the sum of n and m is greater than 2, and the values of n and m can be identical or different. In an embodiment, n and m are in a range of about 1 to 1000000, such as several, tens, hundreds, thousands, hundreds of thousands, or even larger. Thus, the resolution of the pattern of the light beam L1 can be increased and/or the light beam L1 can provide a diversity of patterns.

Figure 5:
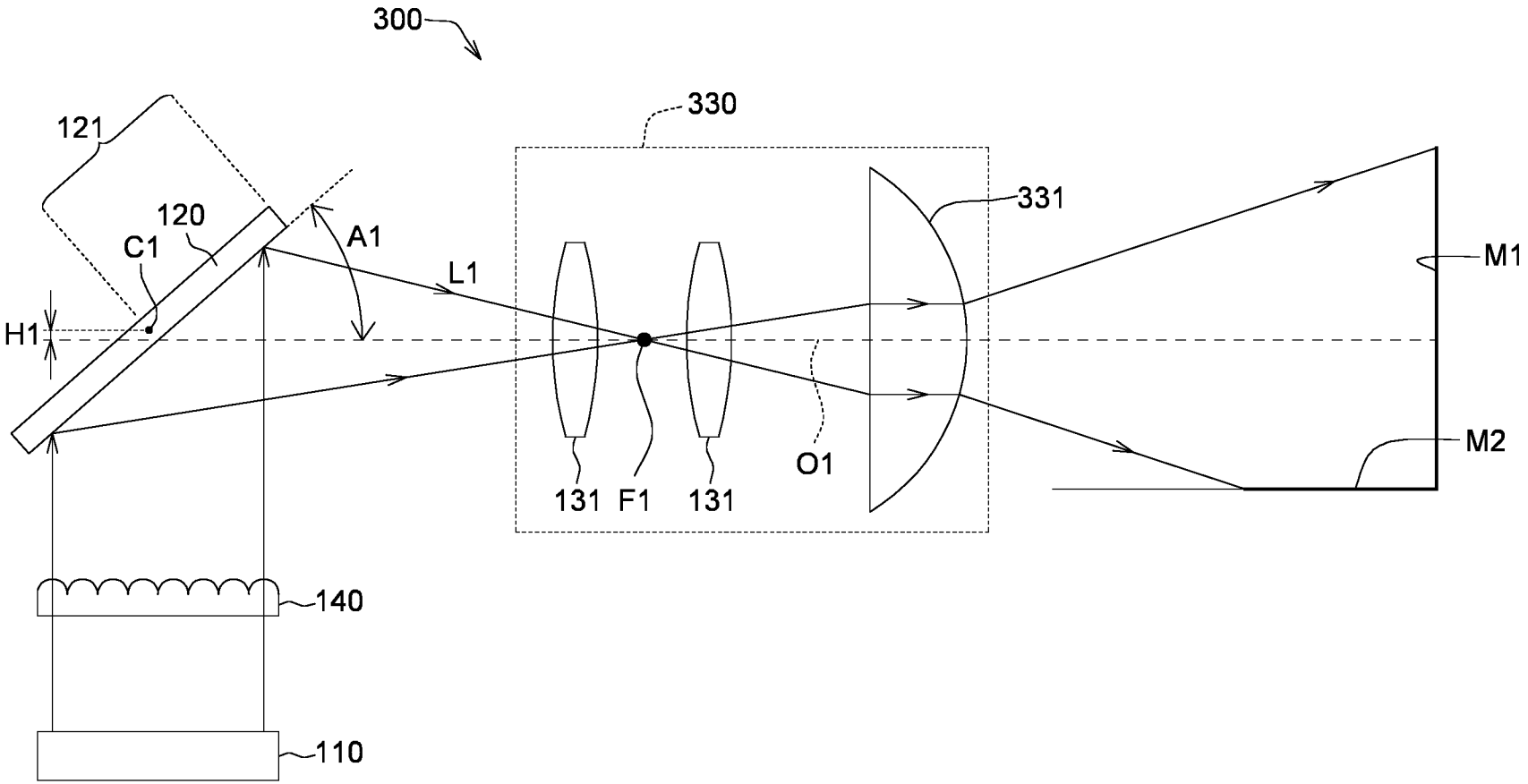
FIG. 5 is a schematic diagram of a projection device 300 according to another embodiment of the present invention.

Referring to FIG. 5, a schematic diagram of a projection device 300 according to another embodiment of the present invention is shown. The projection device 300 includes a light source 110, a light valve 120, a projection lens (or a lens group) 330 and a lens array140.

In the present embodiment, the projection lens 330 includes at least one lens 131 with a diopter, and an anamorphic optical element 331. The number of the lens 131 can be one or more than one, and the lens 131 can be located on the optical path between the light valve 120 and the anamorphic optical element 331. The anamorphic optical element 331 can be located on the optical path between the light source 110 and the light valve 120 or can be located on the optical path between the light valve 120 and the projection lens 130, such as the optical path between the light valve 120 and the lens 131. The anamorphic optical element 331 can change the aspect ratio of the light beam L1 passing through the projection lens 330. In other words, the projection lens 330 can change the aspect ratio of the light emitted from the light source 110, such that the aspect ratio of the projection surface (the first projection surface M1 and the second projection surface M2) is not limited to the aspect ratio of the light emitted from the light source 110.

In an embodiment, the anamorphic optical element 331 may include two lenses, wherein one of the two lenses is a wedge plate, a wedge lens or a lens with a diopter, and the other lens is a wedge plate, a wedge lens or a lens with a diopter. As the two lenses are coupled, the pattern of the light beam L1 passing through the projection lens 330 will be deformed and the dispersion of the light can be compensated. The wedge plate or the wedge lens disclosed above changes the aspect ratio of the light beam L1 passing through the projection lens 330 through the difference in optical paths. Also, the lens with a diopter disclosed above can be a cylindrical lens, a lenticular Lens, a bi-conic lens or a combination thereof, or a lens with a plane, a spherical surface, an aspheric surface or a curvature.

Figure 6A:
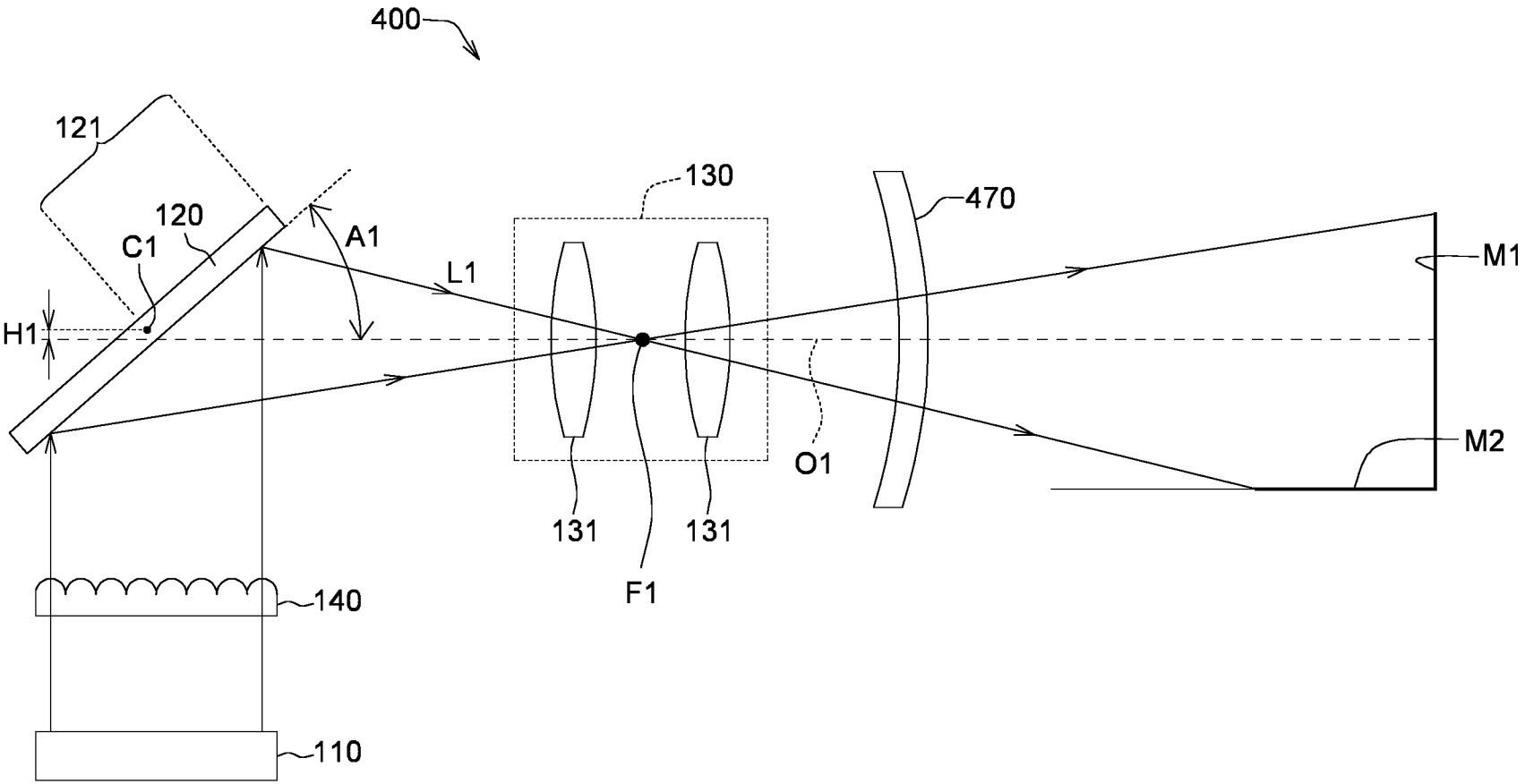
FIGS. 6A and 6B are schematic diagrams of a projection device 400 according to another embodiment of the present invention.
Figure 6B:
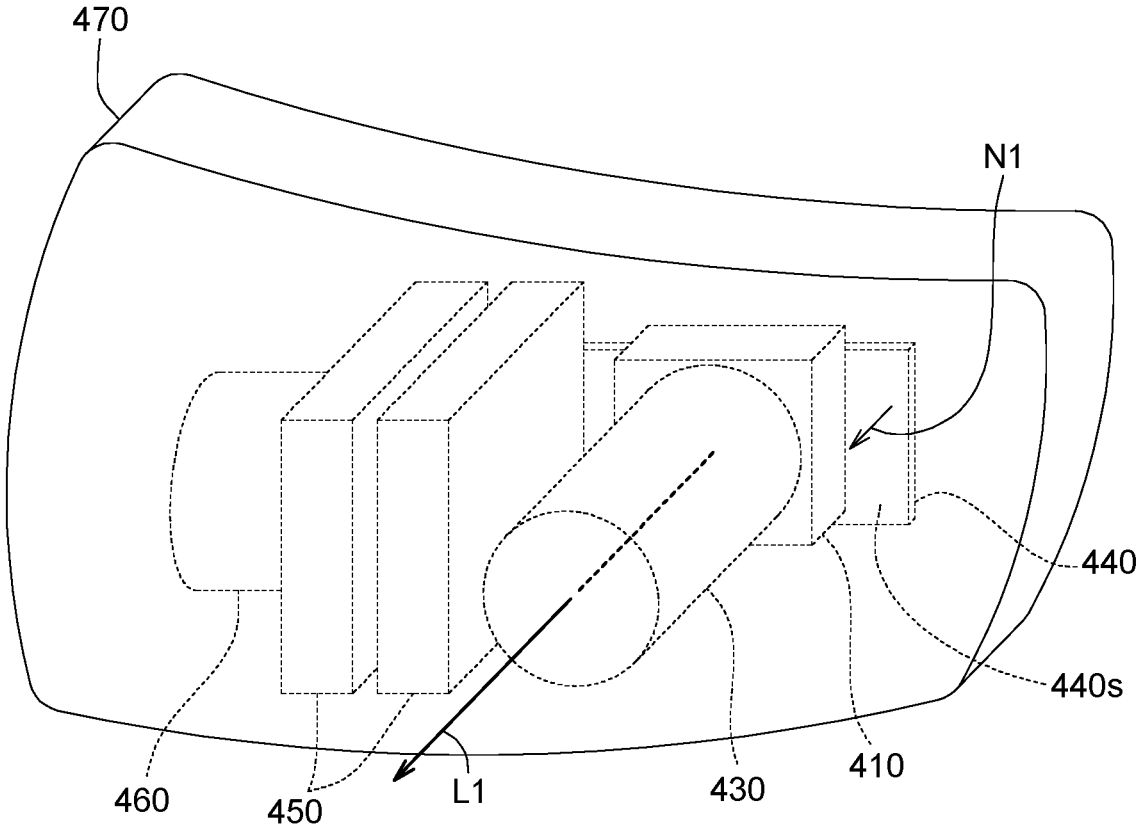

Referring to FIGS. 6A and 6B, schematic diagrams of a projection device 400 according to another embodiment of the present invention are shown. The projection device 400 of the present embodiment is exemplified by a headlight of a vehicle. However, the application of the projection device of the present embodiment is not limited to the headlight of a vehicle. Depending on actual needs, the projection device of the present embodiment can be used in other optical products that require illumination or project patterns.

The projection device (headlight) 400 includes a light source casing 110, the said light valve 210, the said projection lens 130 (or 330), the said lens array 140, a lens barrel 430, a circuit board 440, a cooling fins 450, a fan 460 and a lampshade (the lampshade of a headlight) 470. In another embodiment, the projection device 400 can selectively omit at least one of the light source casing 410, the lens barrel 430, the circuit board 440, the cooling fins 450, the fan 460 and the lampshade 470 that is not required.

The light source 110 is arranged inside the light source casing 410 which protects the light source 110 and avoids light leakage. The projection lens 130 (or 330) is arranged inside the lens barrel 430 which protects the projection lens 130 (or 330). In the present embodiment, the light source 110 is electrically connected to the circuit board 440, such that external signals (not illustrated) can control the light emitting mode the light source 110 through the circuit board 440. The heat generated by the light source 110 can be transferred to the cooling fins 450 through the heat pipe (not illustrated). The fan 460 can dissipate the heat generated by the cooling fins 450 off the projection device 400. The lampshade 470 can cover and protect the light source casing 410, the light source 110, the lens array 140, the lens barrel 430, the projection lens 130 (or 330), the circuit board 440, the cooling fins 450 and the fan 460. In another embodiment, the lampshade 470 can accommodate two or more than two projection modules, wherein one of the two projection modules includes the light source casing 410, the light source 110, the lens array 140, the lens barrel 430, the projection lens 130 (or 330), the circuit board 440, the cooling fins 450 and the fan 460.

The lampshade 470 is located at the downstream of an optical path of the projection lens 130 (or 330). The lampshade 470 allows the light beam L1 passing through the projection lens 130 (or 330) to pass through and exit. The light beam L1 emitted from the lampshade 470 can be projected on the road surface or a remote object. To put it in greater details, the projection lens 130 (or 330) is used for projecting the light beam L1 with a pattern emitted from the light valve 210 passes through the lampshade 470 on a first projection surface and a second projection surface roughly or substantially perpendicular to the first projection surface. As indicated in FIG. 1, the second aspect ratio of the light beam L1 refers to the aspect ratio of the first projection surface or the second projection surface formed by the light beam L2 emitted from the lampshade 470 and projected to the road surface or a remote object. The value of the second aspect ratio is less than or equal to 0.5.

As indicated in FIG. 6B, the light source 110 is arranged on the surface 440*s* of the circuit board 440, and the normal direction N1 of the surface 440*s* is substantially parallel to the optical axis of the light source 110. Although it is not illustrated in the diagram, the projection device 400 may further include a power board electrically connected to the circuit board 440 to transfer an electricity (the electricity may come from an external power source of the projection device 400) to the circuit board 440. In another embodiment, the power board can be arranged outside the projection device 400 and electrically connected to the circuit board 440 through a circuit (not illustrated).

Besides, the manufacturing method of a projection device of the present invention includes the following steps: providing a light source; arranging a light valve at the downstream of an optical path of the light source; and arranging a projection lens at the downstream of an optical path of the light valve, wherein the projection lens is used for projecting a light beam emitted from the light source on a first projection surface and a second projection surface roughly or substantially perpendicular to the first projection surface, and the light valve is located on an optical axis of the projection lens and is tilted with respect to the projection lens to form an acute angle with the optical axis. However, the projection device of the present invention can also be manufactured using other manufacturing methods and is not restricted by the above manufacturing processes.

As indicated in the projection device of the present invention, the light valve or the light source is tilted with respect to the optical axis, such that the resolution of one of the projection surfaces (such as the second projection surface M2) can be increased, and the projection device can provide a satisfactory projection quality. Each of the projection devices 100, 200, 300 and 400 can increase the resolution of one of the projection surfaces (such as the second projection surface M2) as indicated in FIG. 3 and can provide a satisfactory projection quality.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A projection device for vehicle, comprising:
- a light source;
- a light valve located at a downstream of an optical path of the light source;
- a projection lens located at a downstream of an optical path of the light valve, wherein the projection lens has an optical axis;
- wherein the light valve is located on the optical axis of the projection lens and is tilted with respect to the projection lens to form an acute angle with the optical axis, and the projection lens is used for projecting a light beam emitted from the light source on a first projection surface and a second projection surface substantially perpendicular to the first projection surface.

2. The projection device according to claim 1, wherein the acute angle is in a range of 84° to 88°.

3. The projection device according to claim 1, wherein a center of the light valve is located above the optical axis.

4. The projection device according to claim 3, wherein a shortest distance between the center of the light valve and the optical axis is in a range of 0.01 to 3 mm.

5. The projection device according to claim 1, wherein a center of the light valve is located on the optical axis.

6. The projection device according to claim 1, further comprising:
- a lens array located on an optical path between the light source and the light valve.

7. The projection device according to claim 1, wherein the projection lens comprises:
- an anamorphic optical element located at the downstream of the optical path of the light valve.

8. The projection device according to claim 7, wherein the anamorphic optical element is selected from cylindrical lens, bi-conic lens, lenticular lens, wedge lens, wedge plate or a combination thereof.

9. A projection device for vehicle, comprising:
- a light valve, comprising a plurality of self-luminous light-emitting elements arranged in form of a matrix;
- a projection lens located at a downstream of an optical path of the light valve, wherein the projection lens has an optical axis; and
- a lampshade located at a downstream of an optical path of the projection lens;
- wherein the light valve is located on the optical axis of the projection lens and is tilted with respect to the projection lens to form an acute angle with the optical axis, the projection lens is used for projecting a light beam with a pattern emitted from the light valve passes through the lampshade on a first projection surface and a second projection surface substantially perpendicular to the first projection surface.

10. The projection device according to claim 9, wherein the acute angle is in a range of 84° to 88°.

11. The projection device according to claim 9, wherein a center of the light valve is located above the optical axis.

12. The projection device according to claim 11, wherein a shortest distance between the center of the light valve and the optical axis is in a range of 0.01 to 3 mm.

13. The projection device according to claim 9, wherein a center of the light valve is located on the optical axis.

14. The projection device according to claim 9, further comprising:
- a lens array located on an optical path between the light source and the light valve.

15. The projection device according to claim 9, wherein the projection lens comprises:
- an anamorphic optical element located at the downstream of the optical path of the light valve.

16. The projection device according to claim 15, wherein the anamorphic optical element is selected from cylindrical lens, bi-conic lens, lenticular lens, wedge lens, wedge plate or a combination thereof.

17. A headlight, comprising:
- a self-luminous light valve;
- a lens group located at a downstream of an optical path of the self-luminous light valve; and
- a lampshade located at a downstream of an optical path of the lens group;

wherein the optical axis of the self-luminous light valve substantially is not parallel to an optical axis of the lens group, the lens group is used for projecting a light beam with a pattern emitted from the self-luminous light valve passes through the lampshade on a first projection surface and a second projection surface substantially perpendicular to the first projection surface.

18. The headlight according to claim 17, wherein a center of the self-luminous light valve is located above the optical axis.

19. The headlight according to claim 17, wherein the lens group comprises:

an anamorphic optical element located at the downstream of the optical path of the self-luminous light valve.

20. The projection device according to claim 17, wherein the anamorphic optical element is selected from cylindrical lens, bi-conic lens, lenticular lens, wedge lens, wedge plate or a combination thereof.

* * * * *